US005209247A

United States Patent [19]

Rittershaus et al.

[11] Patent Number: 5,209,247

[45] Date of Patent: May 11, 1993

[54] SYSTEM FOR MANUFACTURING AND PACKAGING CIGARETTES

[75] Inventors: Erhard Rittershaus, Hamburg; Werner Zapf, Bayreuth; Horst Bäse, Wentorf; Walter Kitzing, Pinneberg, all of Fed. Rep. of Germany

[73] Assignees: B.A.T. Cigarettenfabriken GmbH; Körber AG, both of Hamburg, Fed. Rep. of Germany

[21] Appl. No.: 710,278

[22] Filed: Jun. 4, 1991

[30] Foreign Application Priority Data

Jun. 7, 1990 [DE] Fed. Rep. of Germany ..... 4018266

[51] Int. Cl.[5] ..... A24C 5/10; A24C 5/20

[52] U.S. Cl. ..... 131/58; 901/9

[58] Field of Search ..... 131/282, 58; 901/1, 901/7, 9

[56] References Cited

FOREIGN PATENT DOCUMENTS 3519580 5/1987 Fed. Rep. of Germany .

3627670 3/1988 Fed. Rep. of Germany .

*Primary Examiner*—V. Millin

*Assistant Examiner*—J. Doyle

*Attorney, Agent, or Firm*—Peter K. Kontler

[57] ABSTRACT

In a system for manufacturing and packaging cigarettes each production unit comprising a cigarette making machine and packaging machines has associated therewith a supply station to which bobbins of raw materials are supplied, that is tipping paper, cigarette paper, carton wrapping paper, inner frame material, box blanks, pack blanks, metallized paper and cellophane or polypropylene, this being done on pallets allocated for each single article. The supply station is spanned by a portal. A portal robot movable longitudinally and transversely of the portal is provided for handling the bobbins of raw materials. Transport means are likewise provided for conveying the raw materials to the individual machines of the system and a bobbin changer is associated with each individual supply station for bobbins. The portal robot comprises an automatic tool changer. The portal, which can span both the supply stations and the bobbin changers, enables the portal robot to supply the bobbins directly to the bobbin changers and material waste to a waste station.

14 Claims, 5 Drawing Sheets

SYSTEM FOR MANUFACTURING AND PACKAGING CIGARETTES

BACKGROUND OF THE INVENTION

1. Field of the Invention

The invention relates to a system for manufacturing and packaging cigarettes comprising at least one cigarette making machine, packaging machines for packaging the cigarettes in packages, cartons and boxes, a conveying system for the transport of pallets with raw materials allocated for each single article from a central store to a plurality of supply and removal stations of an intermediate store station which is associated with a production unit comprising at least one cigarette making machine and the associated packaging machines, a portal preferably completely spanning the supply and removal stations, a portal robot for lifting the raw materials from a supply station, the portal robot being movable longitudinally and transversely of a horizontal crosshead of the portal and taking the raw materials from the supply station, one or more transport means for conveying the raw materials to the individual cigarette making and packaging machines and an automatic tool changer at the portal robot.

2. Description of the Prior Art

For large-scale industrial manufacture of cigarettes at present cigarette making machines are used which can make up to 10,000 cigarettes per minute. These cigarettes must be immediately further processed, that is packed in packages, cartons (cigarette cartons) and finally in boxes. The supplying of the materials necessary for the packaging of the cigarettes presents logistical problems and as a result the permanent supplying of the manufacturing and packaging machines with a trouble free permanent flow of packaging materials is often not ensured.

For this reason a great number of different variants of such systems has been developed, in particular also from the point of view of simplifying the loading of the individual machines with the raw materials, for example blanks for packs, cartons and boxes, carton wrapping paper, inner frame material, cigarette paper, tipping paper, aluminum foils and cellophane or polypropylene.

From German patent 3,519,580 for example a system is known for manufacturing and packaging cigarettes in which a floor conveyor system transports pallets with raw materials from the central store to a supply station which is associated with a production unit consisting of a cigarette making machine and the associated packaging machines. On each pallet supplied only one uniform type of raw materials is present, this type of material being supplied by the manufacturer of said raw materials on said pallet.

The cigarette making machine and the packaging machines of each production unit according to German patent 3,519,580 are connected by a U-shaped rail for a robot arm guided overhead which depending on the requirements brings the raw materials from the supply station to the requesting cigarette making or packaging machine of the production unit and automatically carries out the tool change which might be necessary for this purpose.

In another system known from German patent 3,627,670 for manufacturing and packaging cigarettes there is associated with each production unit comprising a cigarette making machine and packaging machines a supply station to which the raw materials, that is tipping paper, cigarette paper, carton wrapping paper, inner frame material, box blanks, package blanks, metallized paper, cellophane and polypropylene, are supplied on pallets allocated for each single article. The supply station is spanned by a portal on which a robot can be moved in horizontal direction. The robot transfers the transport box blanks and the package blanks to a corresponding feed means whereas the other raw materials, in particular bobbins are transferred by the robot to a handling device of a carriage of an electric overhead conveyor trolley which can travel along a guided rail to the individual points of use. The handling device transfers the raw material to the respective use point, in particular a bobbin changer.

It is however not possible with the robot to supply the bobbin changers directly with raw material from the pallet because the robot can only pass the various raw materials onto a transport means which finally supplies the bobbin changers. In addition to the relatively long supply paths here relatively large redundance times are necessary to ensure the supply. Additional sources of errors can lead to total standstill of the entire manufacturing and packaging system.

In an article in the March edition of the 1989 volume of the technical journal "World Tobacco", page 17 et seq., under the title "FOUND—THE MISSING LINK OF AUTOMATIC STORES-TO-MACHINE MATERIALS FEEDING" an interface unit is described which is supplied by automatically driven vehicles (AGVs) and which is connected via a pnaumatic web transport system to a cigarette making machine. The pneumatic web transport system supplies the necessary raw materials, which are present in web form, such as cigarette paper, via a transport system operated with an air stream. At the interface unit various modules having storage stations allocated for each type of web comprising integrated bobbin changers/removal stations are provided which are connected to said pneumatic transport systems. A disadvantage of this known system is that bobbins have to be continuously replenished, in particular when the bobbin supply drops below a certain level. Since the modules have only a limited capacity, replenishment must be carried out very frequently. From economical points of view it is not practicable to increase the size of the modules. Moreover, it is only possible to prepare and pass on web-like materials for the supplying of the cigarette making machine.

OBJECT OF THE INVENTION

The invention has as its object to provide a system for manufacturing and packaging cigarettes of the type set forth above in which the aforementioned disadvantages do not occur. In particular, a system is proposed which overcomes to an even greater extent the problems of the transport of the packaging materials from the supply station to the individual machines.

SUMMARY OF THE INVENTION

The invention proposes in a system for manufacturing and packaging cigarettes comprising at least one cigarette making machine, packaging machines for packaging the cigarettes in packages, cartons and boxes, a conveying system for the transport of pallets with raw materials allocated for each single article from a central store to a plurality of supply and removal stations of an intermediate store station which is associated with a production unit comprising at least one cigarette making machine and the associated packaging machines, a portal preferably completely spanning the supply stations, a portal robot for lifting the raw materials from a supply station, the portal robot being movable longitudinally and transversely of a horizontal crosshead of the portal and taking the raw materials from the supply station, one or more transport means for conveying the raw materials to the individual cigarette making and package machines and an automatic tool changer at the portal robot, the improvement in which a bobbin changer is associated with each supply station, the portal spans both the supply stations and the associated bobbin changers and the portal robot supplies the bobbins from the supply stations to the bobbin changers.

Such a bobbin changer is a splice station on which the material strip of the full bobbin is attached to the running out strip of the empty bobbin core. Bobbins are not actually changed but instead full bobbins are supplied, connected to the running out bobbins and after emptying of the running bobbins pivoted to the runout position and the empty cores or cores to which residual strips adhere are carried away. The supplying and removing of full or empty bobbins is carried out by the robot whilst the splicer connects the strips and ejects the core.

According to the invention each bobbin supply station is equipped with such a bobbin changer. In addition, the portal spans both the supply stations and the bobbin changers. The portal robot supplies the bobbins directly to the bobbin changers.

Another advantage of this system according to the invention is that the pallets completely loaded with raw materials which are allocated to each single article, as supplied by the respective manufacturers, can be supplied directly, for example via an automatic transport system, to the respective supply stations where the raw materials can be picked up as required by the portal robot in order to be supplied to the respective bobbin changer. The system according to the invention therefore makes it possible to use whole pallets for supplying and removing without having to carry out any additional commissioning, i.e. managing of loading and unloading, sorting or the like.

In a further advantageous development for the transport from the bobbin changers to the machines processing the materials supplied pneumatic transport means may be provided. This permits an almost contactless transport of web-like raw materials.

If as quick as possible a charging of the bobbin changers is to be achieved it is advantageous to equip the portal robot with more than one robot arm. In this manner the one arm of the portal robot can remove the residues of a used bobbin whilst the other robot arm already grips a new bobbin to transfer the latter to the bobbin changer.

If a plurality of bobbin supply stations of the system of the invention are to be synchronously charged and discharged, it is advantageous to provide on the portal at least two in particular separately controllable portal robots which can be used to a limited extent independently of each other at a respective bobbin supply station. Each of these portal robots may be equipped with two separately controllable robot arms.

To simplify the handling of such a complex system it is advantageous to provide control electronics for coordinating the activities of the system. For relatively simple systems even a stored-program control may suffice.

However, a more complex system will require correspondingly more extensively configured control electronics.

For redundance reasons or should the packaging material not offer any other alternative, at least one mechanical belt transport means should be provided for transporting blanks to the respective packaging machines.

The portal robot or robots should also be employable for supplying box blanks and for this reason the portal may also extend into the region of the box blank supply means. This increases the flexibility of the system and reduces the fault liability. Less frequently required materials, for example carton wrapping paper, may also be supplied via conical roller paths, the carton wrapping paper being further conducted via linear units to the bobbin changers. Other less frequently needed materials can be passed to the bobbin changers via mechanical aids of this or a similar type. Such an embodiment may be desirable from economical points of view.

To control the stocking and supplying of the system according to the invention a decentralized sensor system may be provided at the supply station for monitoring the supply. This makes it possible to control for example via bar code readers which materials are required at which point, whether the correct materials have been supplied to the correct location, whether the portal robot has the correct raw materials available and passes them to the bobbin changers, and so on. In dependence thereon, the automatically controlled transport vehicles (AGVs) may be commanded and controlled.

These functions may also be implemented if a central sensor system is provided on the portal robot or the arms thereof. If a plurality of portal robots are provided and have one or more arms the latter should also be provided with a correspondingly centrally connected sensor system. It is also possible to provide a fixedly located central sensor system in the system according to the invention past which the portal robots move the raw materials for identification thereof. Accordingly, various modifications of the system according to the invention can be implemented with a central or decentral sensor system having the aforementioned advantages.

An additional transport means and removal means for removing waste taken by the portal robot or robots from the bobbin changers and the supply stations can advantageously be mounted on the portal in such a manner that it lies within the range of the portal robot or robots.

The invention will be explained in detail hereinafter with reference to examples of embodiment with the aid of the attached schematic drawings. This will make further features and advantages of the system according to the invention apparent.

DESCRIPTION OF PREFERRED EMBODIMENTS

Figure 1:
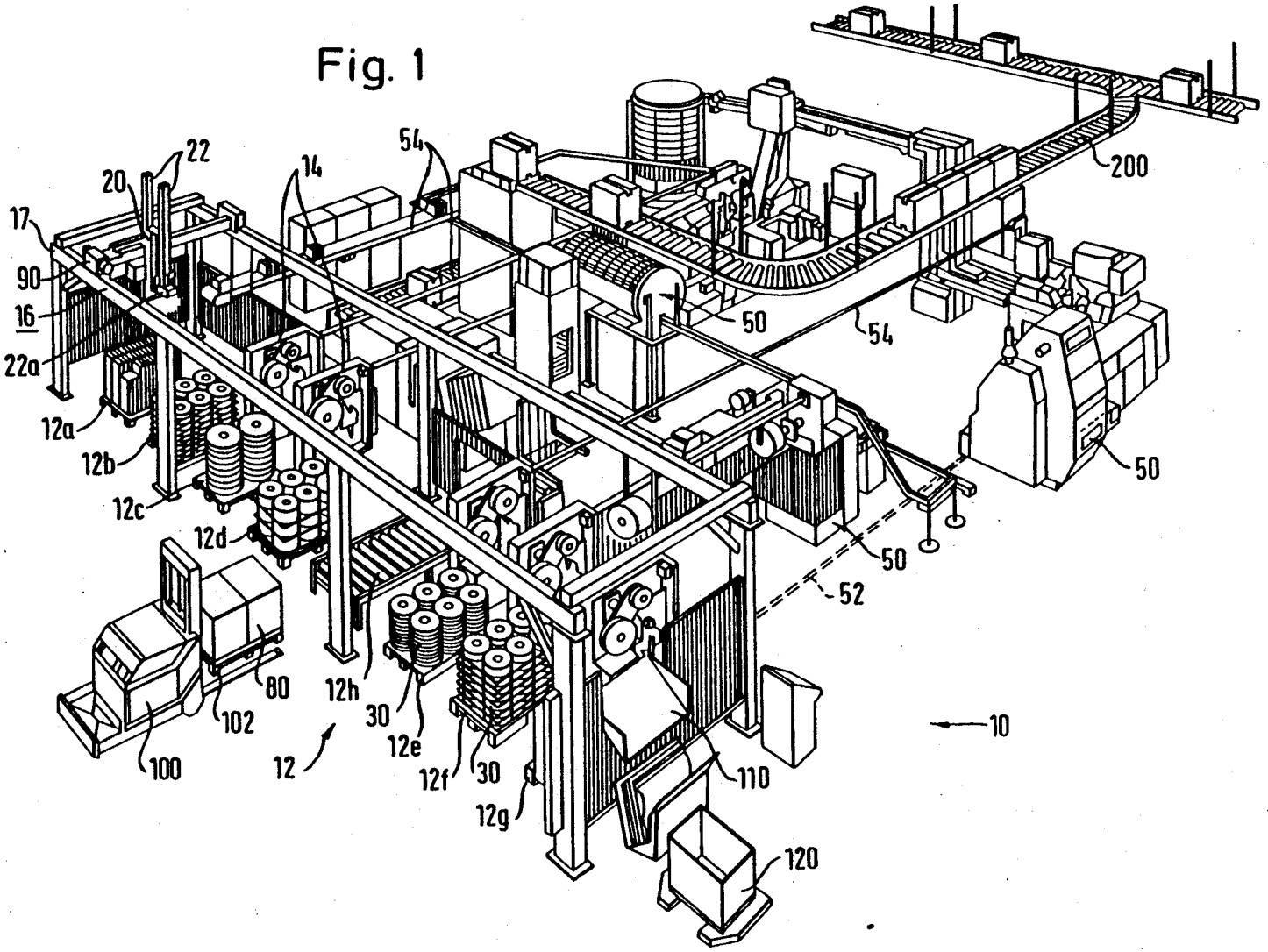
FIG. 1 is a perspective view of a system according to the invention.

In FIG. 1 the system for manufacturing and packaging cigarettes according to the invention is denoted generally by the reference numeral 10. An intermediate storage station 12 is supplied by an automatically controlled transport vehicle (AGV) 100 with packaging materials 80 on pallets 102. Behind the intermediate storage station 12 machines 50 are arranged which process the raw materials such as transport boxes delivered from the intermediate storage station 12. The machines denoted in the present case only by way of example generally by the reference numeral 50 serve to manufacture the cigarettes themselves and for packaging cigarettes just produced. The finished boxes with cigarettes packaged in cartons and packs are carried away via a roller path 200 to a store or directly for distribution. Via overground transport paths 54 and in-floor transport paths 52 the intermediate storage station 12 or the components arranged there are connected to the cigarette making machines and the packaging machines 50. Through the transport channels 52, 54 the mainly web-like materials are conveyed protected to the further processing machines 50. The transport operation in the in-floor transport channel 52 can be carried out in conventional manner, for example via transport rollers, or alternatively pneumatically. For the pneumatic transport one or more air streams are conducted in the direction of the transport path into the channel 52. Said air streams convey the web-like material, for example cigarette paper, and simultaneously hold it at a distance from the channel walls. In the same manner the overground transport paths or passages 54 can also be operated both conventionally and pneumatically.

In accordance with the invention the entire intermediate storage station 12 is spanned by a portal 16. The longitudinal beams 17 of the portal 16 are employed both to increase the mechanical stability and as guide rails for a portal robot 20. The robot 20 is mounted via guide means 90 on the longitudinal beams 17. The portal robot is equipped with at least one but preferably two robot arms 22. At the ends of the robot arms 22 tools 22*a* are connected in preferably reversible manner. Said tools 22*a* are as a rule exchangeable gripping tools with the aid of which it is possible on the one hand to grip the bobbins 30 to enable them to be placed onto the changing stations of the bobbin changers 14 and on the other to remove residues from exhausted or run out bobbins 30 from the bobbin changers 14. In addition, with these gripping tools 22*a* blank stacks, for example hinge lid blanks, are placed onto roller transport systems which convey the blanks to the processing machine.

The intermediate storage station 12 includes a plurality of supply stations 12*a* to 12*g* to which the raw materials 80 are supplied by AGVs, that is a station 12*a* for hinge lid blanks, a station 12*b* for aluminum bobbins, a station 12*c* for inner frame bobbins, a station 12*d* for carton wrapping paper bobbins, a station 12*e* for tipping paper bobbins, a station 12*f* for polypropylene bobbins and a station 12*g* for cigarette paper bobbins. The stations 12*a* to 12*g* are arranged adjacent each other in the order given (see also FIG. 2).

Since the portal 16 spans all the supply stations 12*a* to 12*g* the portal robot 20 has access to all types of bobbins delivered on pallets 102.

If the tools 22*a* on the robot arms 22 of the portal robot 20 are not suitable for handling all bobbin types, at a certain point of the portal 16 or alternatively directly on the portal robot 20 an automatic tool changer (not illustrated) can be arranged, with the aid of which the specific tool necessary for handling the particular bobbin type can be fitted to the robot arms 22. This installation operation can be carried out reliably due to the particularly configured tool connections.

As already indicated, the portal robot 20 can remove waste, for example from used bobbins, from the bobbin changers 14 and move said waste to a waste removal means 110, 120. From the latter the waste can be carried away from time to time manually or likewise with AGVs 100. To save time it would also be possible for example to arrange beneath one of the longitudinal beams 17 a transport belt which can remove waste from each of the supply stations 12*a* to 12*g* when the portal robot 20 deposits waste thereon. Such an arrangement has the advantage that the portal robot or robots 20 do not require any additional travelling time for removing waste from the supply stations 12*a* to 12*g*. This may be particularly important when only one portal robot 20 is provided with a relatively low capacity for supplying the system 10.

Figure 5A:
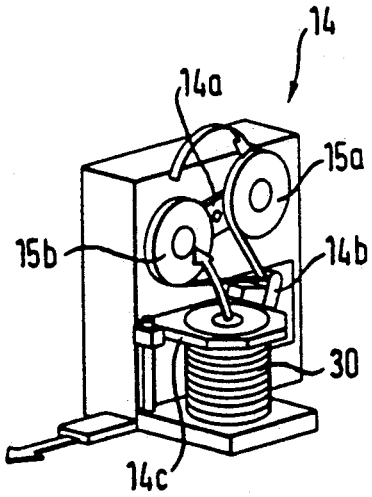
FIGS. 5A and 5B show perspective schematic views of suitable bobbin changers.
Figure 5B:
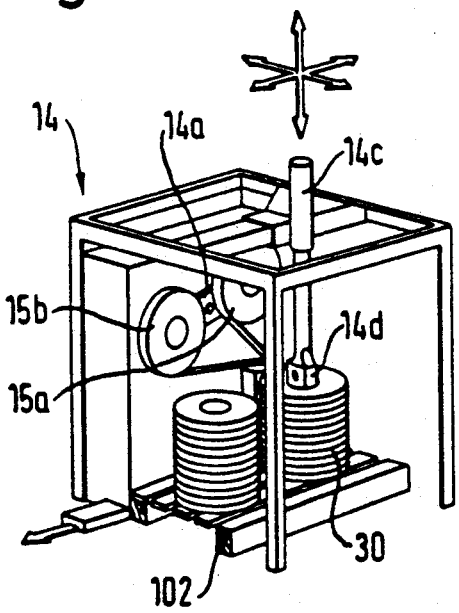

Each of the bobbin supply stations 12*b* to 12*g* is equipped with a bobbin changer 14 of the type shown for example in FIGS. 5A and 5B, in particular FIG. 5A.

Travelling times can also be saved by providing on the portal robot 20 a sensor system which makes it possible for example via a bar code reader to determine which type of packaging material is being handled at a given time. The data acquired on the handled packaging materials can be processed in a central control computer for coordinating the stocking and controlling the AGVs 100.

As a rule, the bobbin changers 14 are also connected via control and/or data lines to the central control computer. Via the data lines a bobbin changer 14 can provide the control computer with information on its operating state. If for example a bobbin is exhausted and the exhausted bobbin pivots into the rest position whilst the fresh bobbin disposed in the reserve position pivots into the supply position a corresponding signal is given by the bobbin changer 14 to the control computer. The control computer thereupon passes to the portal robot 20 the command to remove the empty bobbin from the reserve position of the respective bobbin changer 14 and place a new bobbin of the desired type into the reserve position. In conflict situations, i.e. when two bobbin changers simultaneously send corresponding data to the control computer, the latter decides on the basis of the frequency of the use of the corresponding raw materials which of the respective bobbin changers 14 is to be served first by the portal robot 20.

It is of course also possible to provide further higher resolution sensors on the bobbin changers 14 and the portal robot 20 in order to make further decision aids.

Since the portal 16 spans both the supply stations 12*a* to 12*g* and the bobbin changers 14 it is possible to place pallets 102 with certain uniform raw materials, for example new materials such as cigarette paper, aluminum foil or the like, in specific bobbin supply stations 12*b* to 12*g* where they can be reached by the portal robot 20. The portal robot 20, in the range of which the bobbin changers 14 may also be located, can grip at the appropriate time the desired bobbin type with a universal or specific gripping tool 22*a* and supply said bobbin type to the respective bobbin changer 14.

Said bobbin changer 14 replaces the exhausted bobbin, when required, by a full bobbin. The threading in of the raw material takes place automatically.

The reach of the portal robot 20 or the position of a feed means 12*h* for transport box blanks 80 can be configured so that the portal robot 20 can also be used to handle the transport box blanks 80. For this purpose, as a rule a special tool is provided with which the robot arms 22 of the portal robot 20 can be fitted by the automatic tool changer.

Figure 2:
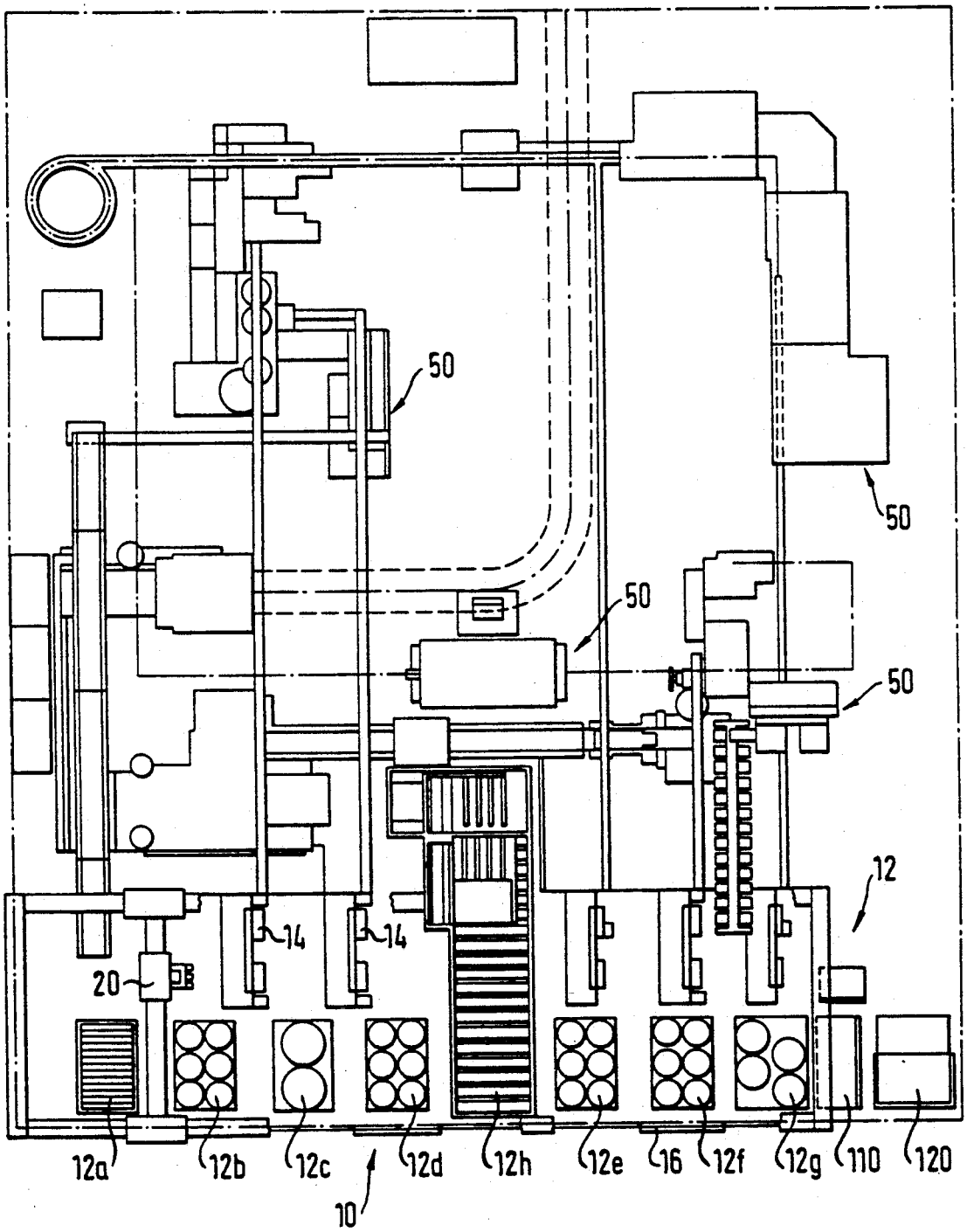
FIG. 2 is a schematic plan view of the system according to FIG. 1.

FIG. 2 is a schematic plan view of the system shown in FIG. 1. It can be clearly seen that the portal 16 spans all the supply stations 12*a* to 12*h*. The supply station 12*a* for the hinge lid (HL) blanks and the supply station 12*h* for the box blanks can also be reached and serviced by the portal robot 20 in this manner.

All the supply stations 12*b*, 12*c*, 12*d*, 12*e*, 12*f* and 12*g* of which the raw materials are stored in the form of bobbins are equipped with automatic bobbin changers 14. The portal robot 20 is also able to remove waste from these working stations. For depositing the waste the chute 110 is provided via which the waste can slide for example into the waste container 120.

Figure 3:
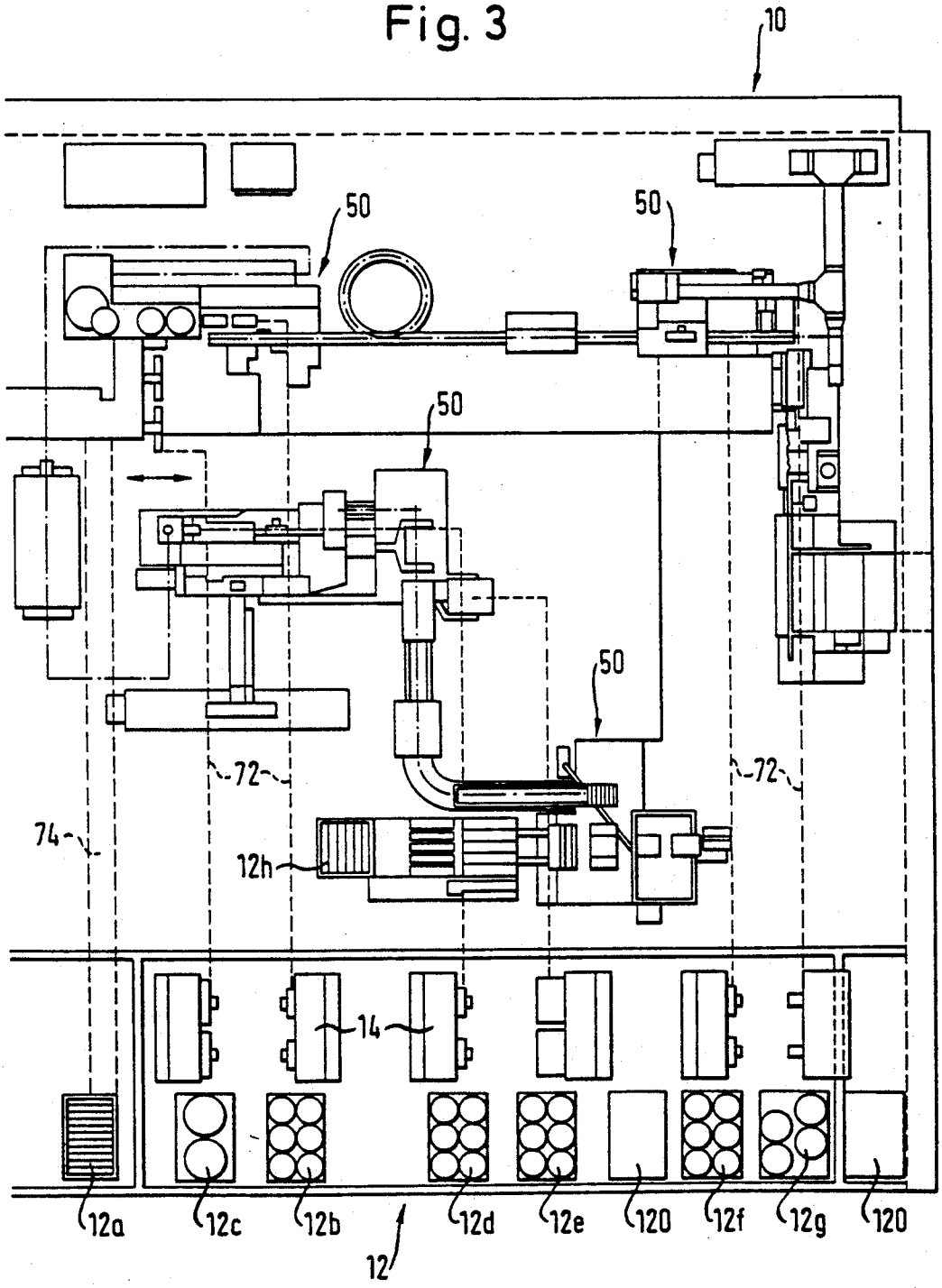
FIG. 3 shows a modified system according to the invention in a schematic plan view.

The modified system which is shown in FIG. 3 is substantially identical to the system of FIGS. 1 and 2. The sole relevant difference resides in the arrangement of the feed means 12*h* for the box blanks outside the access range of the portal robot between the intermediate storage station 12 and the respective production unit. Due to this modified arrangement the other machines 50 of the system according to the invention are also differently arranged. The HL blanks are transported via a transport belt 74 to the associated packaging machine. The reference characters 72 denote paths for the transport of materials from the supply stations of the intermediate storage station 12 to the machines 50.

Figure 4:
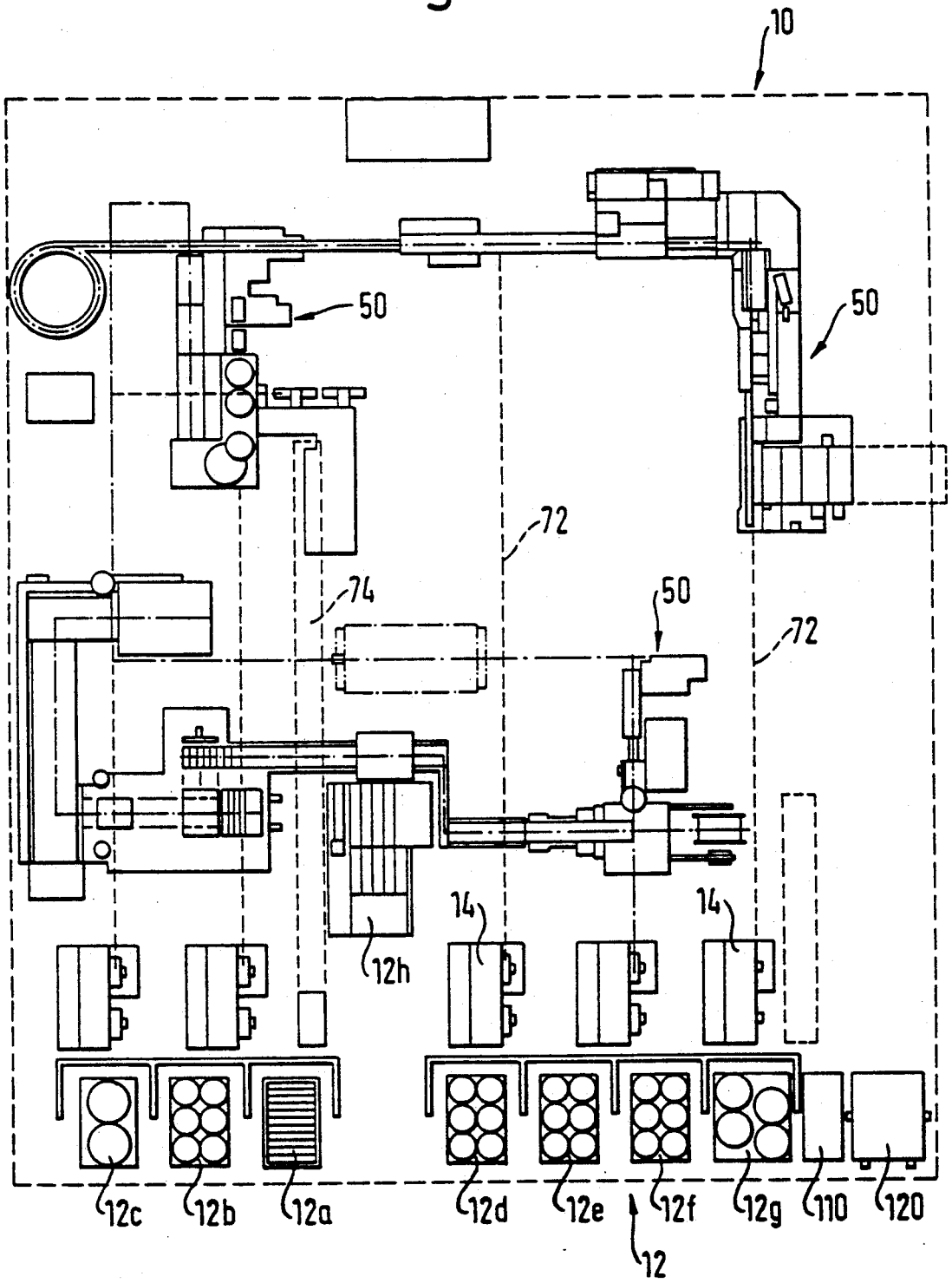
FIG. 4 is a plan view of a further system according to the invention.

The system 10 shown in FIG. 4 for producing and packaging cigarettes also has the essential features of the systems according to FIGS. 1, 2 and 3. The supply stations 12*a* to 12*h* are however arranged in different manner. This also involves a different arrangement of the packaging machines indicated by way of example by the reference numeral 50.

In this case as well the portal 16 with the portal robot 20 is arranged in the same manner as in FIGS. 1 and 2 but for reasons of simplicity is not illustrated.

FIGS. 5A and 5B show two embodiments of automatic bobbin splicing means (bobbin changers) 14.

Essentially, the splicing means 14 according to FIG. 5A comprises a pivot arm 14*a* which is provided with two stations 15*a* and 15*b*. Located at the stations 15*a* and 15*b* are bobbins, of which one (at 15*a*) is used whilst the other remains in a reserve position (at 15*b*). As soon as the bobbin disposed in the use position is exhausted the pivot arm 14*a* pivots the station 15*b* and the bobbin disposed thereon into the use position 15*a*. A threading-in and adhering means 14*b* ensures the gapless connection of the bobbins consecutively disposed in the use position. A gripping means 14*c* charges the station 15*b*. Empty cores are ejected in the position 15*a*.

The bobbin changer 14 illustrated in FIG. 5B is equipped with a more complex gripping means 14*c*, 14*d* which is used to replace exhausted bobbins with new bobbins 30. The gripping means 14*c*, 14*d* in this embodiment is able to grip the bobbins at a central recess whilst the gripping means 14*c* according to FIG. 5A grips the bobbins 30 at their outer periphery. The bobbin splicer according to FIG. 5B is able to administer and process bobbins 30 on a pallet 102. The pivot arm 14*a* of the bobbin splicer according to FIG. 5B and the stations 15*a*, 15*b* operate analogously to those of the bobbin splicer according to FIG. 5A.

FIG. 5B represents the smallest cell of a material supply system according to claim 1.

If expedient, the bobbin splicers 14 used in the system 10 according to the invention need not have an independent bobbin replacement means 14*c* because the portal robot 20 is of course able to carry out the bobbin charging operation.

We claim:

1. A system for manufacturing and packaging cigarettes comprising (a) at least one cigarette making machine, (b) packaging machines associated with said at least one cigarette making machine for packaging the cigarettes in packages, cartons and boxes, (c) a conveying system for the transport of pallets with bobbins of raw materials allocated for each single article from a central store to a plurality of supply and removal stations of an intermediate store station which is associated with a production unit comprising said at least one cigarette making machine and the associated packaging machines, (d) a portal spanning at least some of the supply and removal stations, (e) at least one portal robot for lifting bobbins of raw materials from a selected supply station, (f) the at least one portal robot being movable longitudinally and transversely of an elongated crosshead of the portal and taking bobbins of raw materials from the selected supply station, (g) transport means for conveying bobbins of raw materials to the at least one cigarette making and the associated packaging machines, and (h) an automatic tool changer at the at least one portal robot, comprising:

(i) a bobbin changer associated with each bobbin supply station, (j) the portal spanning both the supply stations and the associated bobbin changers, and (k) the at least one portal robot supplying the bobbins from the bobbin supply stations to the bobbin changers.

2. A system according to claim 1, wherein at least one transport means is provided for the pneumatic transport of the raw materials from the bobbin changers to the cigarette making and packaging machines.

3. A system according to claim 1, wherein at least one mechanical belt transport means is provided for the transport of the raw materials from the bobbin changers to bobbins of cigarette making and packaging machines.

4. A system according to claim 1, wherein the portal robot is equipped with at least one robot arm.

5. A system according to claim 1, wherein at least two separate portal robots are provided.

6. A system according to claim 1, wherein control electronics are provided for coordinating the activities of the system.

7. A system according to claim 1, wherein the portal robot can also be used for supplying the at least one material blanks.

8. A system according to claim 1, wherein the cigarette making and/or packaging machines are supplied with web-like materials by the bobbin changers via an in floor conveying means.

9. A system according to claim 1, wherein for the supply of less frequently required materials roller paths are provided.

10. A system according to claim 1, wherein a decentralized sensor system is provided for monitoring the supplies to the supply stations.

11. A system according to claim 1, wherein a central sensor system is provided on the at least one portal robot.

12. A system according to claim 1, wherein a central sensor system is provided past which the portal robot moves the raw materials for the purpose of identification.

13. A system according to claim 1, wherein the at least one portal robot effects the return of unused materials to the associated supply stations.

14. A system according to claim 1, wherein a transport means is provided for removing the empty cores or waste removed by the at least one portal robot in the range thereof.

* * * * *